US006393665B1

(12) United States Patent
Foster et al.

(10) Patent No.: US 6,393,665 B1
(45) Date of Patent: May 28, 2002

(54) METHOD AND APPARATUS FOR MIXING TEXTILE FIBERS AND PARTICULATE MATERIALS

(76) Inventors: Raymond Keith Foster, P.O. Box 1, Madras, OR (US) 97741; Mark Jay Beason, 1933 SW. 21st, Redmond, OR (US) 97756

( * ) Notice: Subject to any disclaimer, the term of this patent is extended or adjusted under 35 U.S.C. 154(b) by 0 days.

(21) Appl. No.: 09/654,144

(22) Filed: Sep. 1, 2000

(51) Int. Cl.[7] ..... D01B 1/00
(52) U.S. Cl. ..... 19/80 R; 19/145.5
(58) Field of Search ..... 19/65 R, 80 R, 19/85, 87, 90, 91, 93, 94, 97, 97.5, 144, 145.5

(56) References Cited

U.S. PATENT DOCUMENTS 4,117,571 A * 10/1978 Prather ..... 19/80 R
4,190,933 A * 3/1980 Jagst ..... 19/145.5
4,244,082 A * 1/1981 Leifeld et al. ..... 19/145.5
4,479,285 A * 10/1984 Ragan ..... 19/80 R
4,497,085 A * 2/1985 Van Doorn et al. ..... 19/80 R
4,548,131 A * 10/1985 Williams ..... 19/80 R
4,766,648 A * 8/1988 Kerley ..... 19/80 R
4,908,910 A * 3/1990 Pinto et al. ..... 19/145.5
5,025,533 A * 6/1991 Faas et al. ..... 19/145.5
5,121,841 A * 6/1992 Harrington et al. ..... 19/80 R
5,222,675 A * 6/1993 Stover ..... 209/616
5,315,738 A * 5/1994 Pinto et al. ..... 19/145.5
5,340,264 A * 8/1994 Quaeck ..... 414/525.9
5,469,603 A * 11/1995 Stover ..... 19/80 R
5,537,809 A * 7/1996 Blalock ..... 19/80 R
5,934,445 A * 8/1999 Foster et al. ..... 198/750.5

* cited by examiner

*Primary Examiner*—John J. Calvert
*Assistant Examiner*—Gary L. Welch
(74) *Attorney, Agent, or Firm*—Delbert J. Barnard

(57) ABSTRACT

Two dispersers tunnels (20, 22) are provided at a disperser station. Each disperser tunnel (20, 22) houses two dispersers (24, 26 and 28, 30). Each pair of dispersers (24, 26 and 38, 30) are spaced apart and confront each other, with a mixing zone (42, 54) being defined between them. A separate conveyor (32, 34, 36, 38) is provided for feeding textile fiber modules, e.g. cotton boll modules (18, 18', 18", 18'''), to the dispersers (24, 26, 28, 30). Each pair of dispersers (24, 26) removes fiber clumps from the leading ends of the modules (18, 18', 18", 18''') and dispenses them into the mixing zone (42, 54) in admixture with the fiber clumps from the other disperser (24, 26, 28, 30) of the pair. The blend or mixture of fiber clumps is collected in the upper run (50) of a conveyor (52) that serves to carry the fiber clumps away from the disperser station. The feed rate of the modules (18, 18', 18", 18''') may be regulated and varied by regulating and varying the speed rates of the conveyors (32, 34, 36, 38). The feed conveyors may be provided with sidewalls so as to define storage bins. Bodies of particulate material may be stored in the storage bins and feed to the dispersers by use of the feed conveyors. The dispersers can be operated to dispense particles from the bodies of particulate material into the mixing zone, in admixture with particles of the other disperse of the pair. The feed rate of the conveyors can be varied for varying the feed rate of particulate material to the dispersers.

38 Claims, 8 Drawing Sheets

METHOD AND APPARATUS FOR MIXING TEXTILE FIBERS AND PARTICULATE MATERIALS

TECHNICAL FIELD

This invention relates to a method and apparatus for dispersing fiber clumps, e.g. cotton boll clumps, from two or more textile fiber modules, e.g. cotton boll modules, at the same time, and mixing the clumps to form a blend, and to a method and apparatus for mixing particulate materials, e.g. wood chips.

BACKGROUND OF THE INVENTION

Below there is a description of the handling of cotton fibers, starting with the harvesting of cotton bolls. However, the invention is not limited to the handling of cotton fibers but rather applies equally as well to the handling of other textile fibers that have been compressed into large modules that need to be mechanically dispersed into clumps of fibers so that the fibers can be separated, cleaned and then further processed, ultimately into yarns. It also applies to mixing particulate materials, e.g. wood chips.

As known to those skilled in the art, cotton plants produce seedpods, known as cotton bolls, which contain the seeds. Seed hairs, or fibers, growing from the outer skin of the seeds, become tightly packed within the boll, which bursts open upon maturity, revealing soft masses of the fibers. These fibers are white to yellowish white in color, range from about 0.75 to about 1.5 inches in length and are composed of about 85–90% cellulose, a carbohydrate plant substance; five to eight percent water; and four to six percent natural impurities.

Cotton is harvested when the bolls open. In the fields, the cotton bolls are tightly compressed into large modules which are transported from the fields to processing plants. In the processing plants, the modules are mechanically dispersed into clumps of bolls and then the fibers are separated from the seeds and are cleaned and then are further processed, ultimately into yarns.

It is known to disperse the cotton boll modules by use of a stack of rolls that include fingers which rotate into an advancing end of a cotton module, to tear loose clumps of the bolls from the module as they rotate. The stack of rolls is termed a disperser and it is common to use conveyors for delivering the cotton modules to the disperser. Example disperser systems are disclosed by the following United States Patents: U.S. Pat. No. 4,497,085, granted Feb. 5, 1985 to Donald W. Van Doorn, James B. Hawkins, Tommy W. Webb and William A. Harmon, Jr.; U.S. Pat. No. 5,121,841, granted Jun. 16, 1992, to Keith Harrington and Donald Rogers; U.S. Pat. No. 5,222,675, granted Jun. 29, 1993, to Jimmy R. Stover; U.S. Pat. No. 5,340,264, granted Aug. 23, 1994, to Manfred W. Quaeck and U.S. Pat. No. 5,469,603, granted Nov. 28, 1995, to Jimmy R. Stover. These patents show examples of the conveyors which have been used, or proposed, for delivering the cotton modules to the disperser. The present invention is not limited to any particular type of conveyor. However, a reciprocating slat conveyor is preferred. Example reciprocating slat conveyors that are suitable are disclosed by U.S. Pat. No. 5,934,445, granted Aug. 10, 1999, to Raymond Keith Foster, Randall M. Foster and Kenneth A. Stout, and U.S. Pat. No. RE 35,022, granted Aug. 22, 1995, to Raymond Keith Foster.

Cotton fibers, for example, may be roughly classified into three main groups, based on staple length (average length of the fibers in a cotton module) and appearance. The first group includes the fine, lustrous fibers with staple length ranging from about 1 to about 2.5 inches and includes types of the highest quality—such as Sea Island, Egyptian and Pima cottons. Least plentiful and most difficult to grow, long-staple cottons are costly and are used mainly for fine fabrics, yarns and hosiery. The second group contains the second group contains the standard medium-staple cotton, such as American Upland, with staple length from about 0.5 to 1.3 inches. The third group includes the short-staple, coarse cottons, ranging from about 0.375 to 1 inch in length, used to make carpets and blankets, and to make coarse and inexpensive fabrics when blended with other fibers. Within each group, the quality of the fibers can vary depending on such things as where the cotton is grown. It is desirable to blend the lower quality fibers with higher quality fibers to produce an acceptable quality blend of fibers. It is an object of the present invention to provide a method and apparatus for blending cotton clumps as they are removed from the cotton modules. The clumps of bolls are mixed together to form the blend and then the blend is further processed to separate the fibers from the seeds, etc.

Another object of the present invention is to provide a method and apparatus for blending other types of textile fiber clumps as they are removed from the textile fiber modules. Clumps from different modules are mixed together to form a blend of the fibers and then the blend is conveyed on for further processing.

It is yet another object of the invention to provide a method and apparatus for mixing particulate materials, such as different types and/or grades of wood fiber chips, and wood fiber chips with other materials, e.g. granule recycled plastic.

BRIEF DESCRIPTION OF THE INVENTION

One apparatus of the present invention is basically characterized by a pair of confronting dispersers, each having an input side and an output side. The output sides of the two dispersers face each other on opposite sides of a mixing zone. A feed conveyor is provided for each disperser. Each feed conveyor is adapted to feed textile fiber modules into the input side of its disperser. An output conveyor is positioned between the two dispersers, at the bottom of the mixing zone. The feed conveyors are adapted to move the modules to the dispersers. Each disperser removes fiber clumps from its module and discharges them airborne into the mixing zone into admixture with fiber clumps delivered airborne into the mixing zone from the other disperser. The mixed blend of fiber clumps falls on the outfeed conveyor and the output conveyor carries the blend away from the mixing zone.

Each disperser comprises a plurality of power driven rolls, each of which is supported for rotation about a horizontal axis and includes a plurality of fingers that move into and then out from the module as the rollers rotate. The fingers are adapted to remove fiber clumps from the module and project them into the mixing zone.

Preferably, the output conveyor extends generally perpendicular to the two feed conveyors. Preferably also, the feed conveyors are reciprocating slat conveyors. The outfeed conveyor may be an endless belt conveyor.

According to an aspect of the invention, the apparatus may comprise first and second pairs of confronting dispersers of the type described, each disperser having its own feed conveyor. The output conveyor picks up a blend of fiber clumps from the first mixing zone and moves the blend onto the second mixing zone where a second blend of fibers and fiber clumps is deposited onto the cotton boll clump already on the output conveyor.

The method of the present invention is basically characterized by positioning first and second dispersers at a disperser station, in a spaced apart confronting relationship, so as to define a mixing zone between them. The first and second dispersers are operated while a first module is fed into the first disperser and a second module is fed into the second disperser. The first and second dispersers are operated so that each will disperse fiber clumps from its module and deliver them into the mixing zone in admixture with the fiber clumps from the other disperser. The mixture of fiber clumps is collected at the bottom of the mixing zone and is carried away from the disperser station.

Another aspect of the invention is to feed the modules against the dispersers by use of conveyors and controlling the feed rate by controlling the conveyor speed.

A further aspect of the invention is to provide third and fourth dispensers at the dispenser station, also in a spaced apart confronting relationship, so as to define a second mixing zone between them. The third and fourth dispersers are operated while a third textile fiber module is fed into the third disperser and a fourth textile fiber module is fed into the fourth disperser. The third and fourth dispersers are operated so that each will disperse fiber clumps from its module and deliver them into the second mixing zone in admixture with the fiber clumps from the other disperser of the pair. The mixture of fiber clumps is collected at the bottom of the second mixing zone, on top of the mixture of fiber clumps from the first mixing zone, and the total mixture is carried away from the disperser station.

Yet another aspect of the invention is to provide an improved disperser roll construction. According to this aspect of the present invention, the disperser roll is provided with an elongated tubular core. At least two axially spaced apart disks are provided in the tubular core. A plurality of elongated tooth support members are spaced around the tubular core. Each tooth support member has an inner portion contacting the core and an outer portion spaced radially outwardly from the core. Each tooth support member is connected to the spaced apart radial disks. A plurality of generally radially outwardly extending teeth are secured to the outer portion of each tooth support member.

Preferably, each tubular core has opposite ends and the disperser roll has support shafts projecting outwardly from the opposite ends of the tubular core.

Preferably also, the disperser roll has at least three axially spaced apart radial disks on the tubular core, dividing the core into at least two axial sections. The elongated tooth support members for each section are spaced angularly in position relative to the tooth support members for the other section.

In preferred form, the disperser roll comprises four axially spaced apart radial disks on the tubular core, dividing the core into three axial sections. The elongated tooth support members for each section are angularly spaced in position from the tooth support members of the adjacent section.

In preferred form, the teeth are detachably secured to the outer portions of the tooth support members. Also, in preferred form, the elongated tooth support members are angle iron members. The inner portion is an inwardly extending first leg of the angle iron member and the outer portion is chordwise extending second leg of the angle iron member.

A still further aspect of the invention is to provide a system which includes two dispersers in a disperser tunnel or four dispersers in two disperser tunnels, and a feed conveyor for each disperser that is at the bottom of an elongated storage bin for a particulate material, e.g. wood chips or the like. In use, the conveyors feed the particulate material to the dispersers. The disperser of each pair picks up particles from the particulate material in its bin and propels them towards the other disperser. The particles from the two dispersers meet and mix within a mixing zone that is located between the dispersers. An outfeed conveyor at the bottom of the mixing zone collects the mixed particles and removes them from the disperser station.

Other objects, advantages and features of the invention will become apparent from the description of the best mode set forth below, from the drawings, from the claims and from the principles that are embodied in the specific structures that are illustrated and described.

BRIEF DESCRIPTION OF THE SEVERAL VIEWS OF THE DRAWINGS

Like reference numerals and letters refer to like parts throughout the several views of the drawing, and.

DETAILED DESCRIPTION OF THE INVENTION

Figures 1, 2:
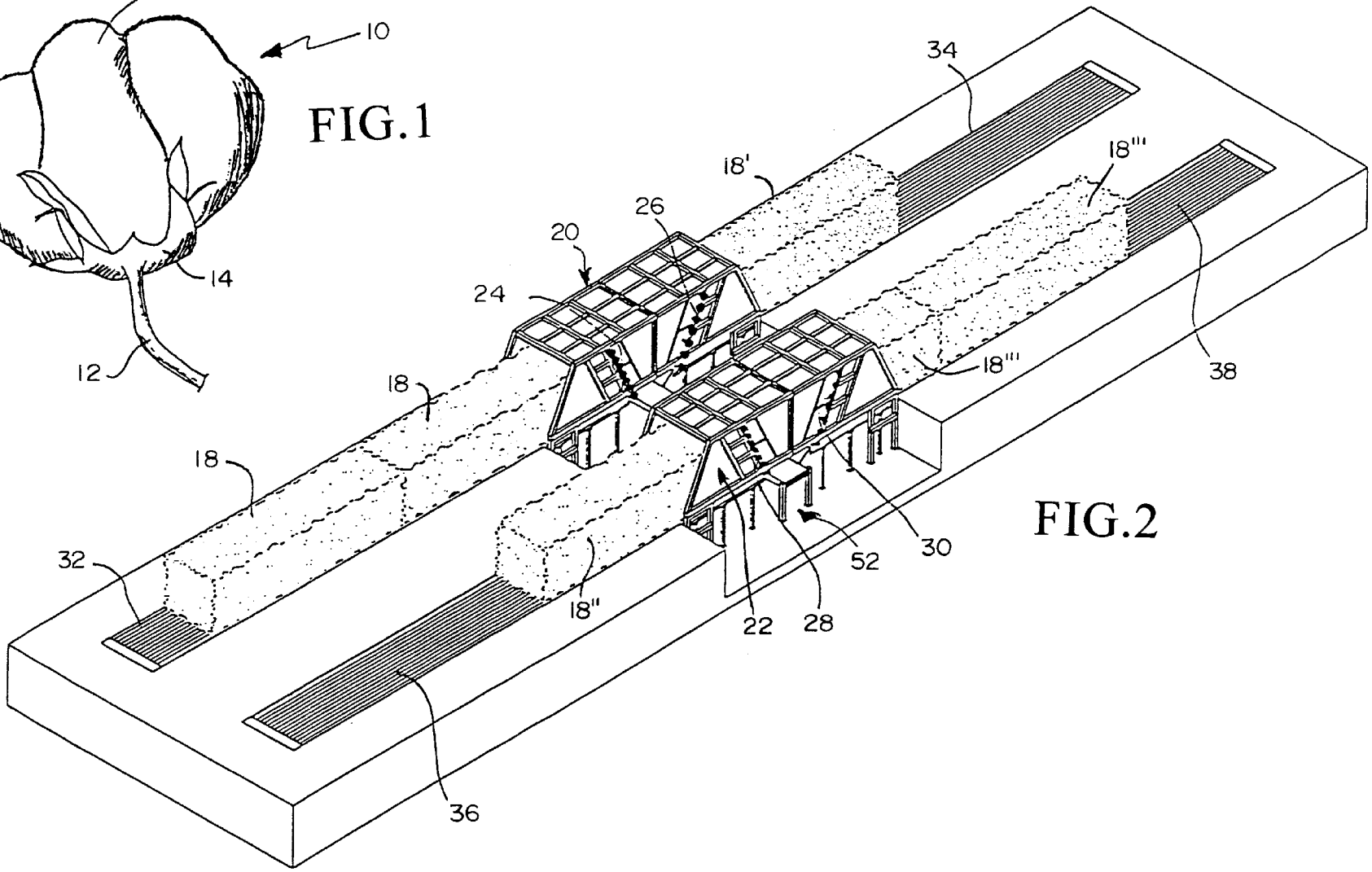
FIG. 1 is a pictorial view of a mature cotton boll, showing how it appears when harvested.
FIG. 2 is a pictorial view of apparatus according to the present invention for dispersing clumps of cotton bolls from a plurality of cotton modules and mixing them together for delivery to the next stage of processing, such view being taken from above and looking towards the top, one side and one end of the apparatus.

FIG. 1 is a pictorial view of a single cotton boll substantially as it appears at harvest time. The boll 10 comprises a stem 12, a base 14 connected to the stem 12 and a ball of seed hairs, or fibers, growing from the outer skin of seeds that are within the boll 10. In a manner that is well known in the art, the cotton bolls 10 are removed from the cotton plant and are tightly compressed into large modules 18, 18', 18", 18'" that are removed from the field and transported to the processing plant.

FIG. 2 shows a disperser station at a processing plant that incorporates the present invention. This disperser station comprises a pair disperser tunnels 20, 22 each including a pair of confronting dispersers 24, 26 and 28, 30. Each disperser, 24, 26, 28, 30 is provided with its own conveyor 32, 34, 36, 38. In the illustrated system, the conveyors 32, 34, 36, 38 are reciprocating slat conveyors.

Figure 3:
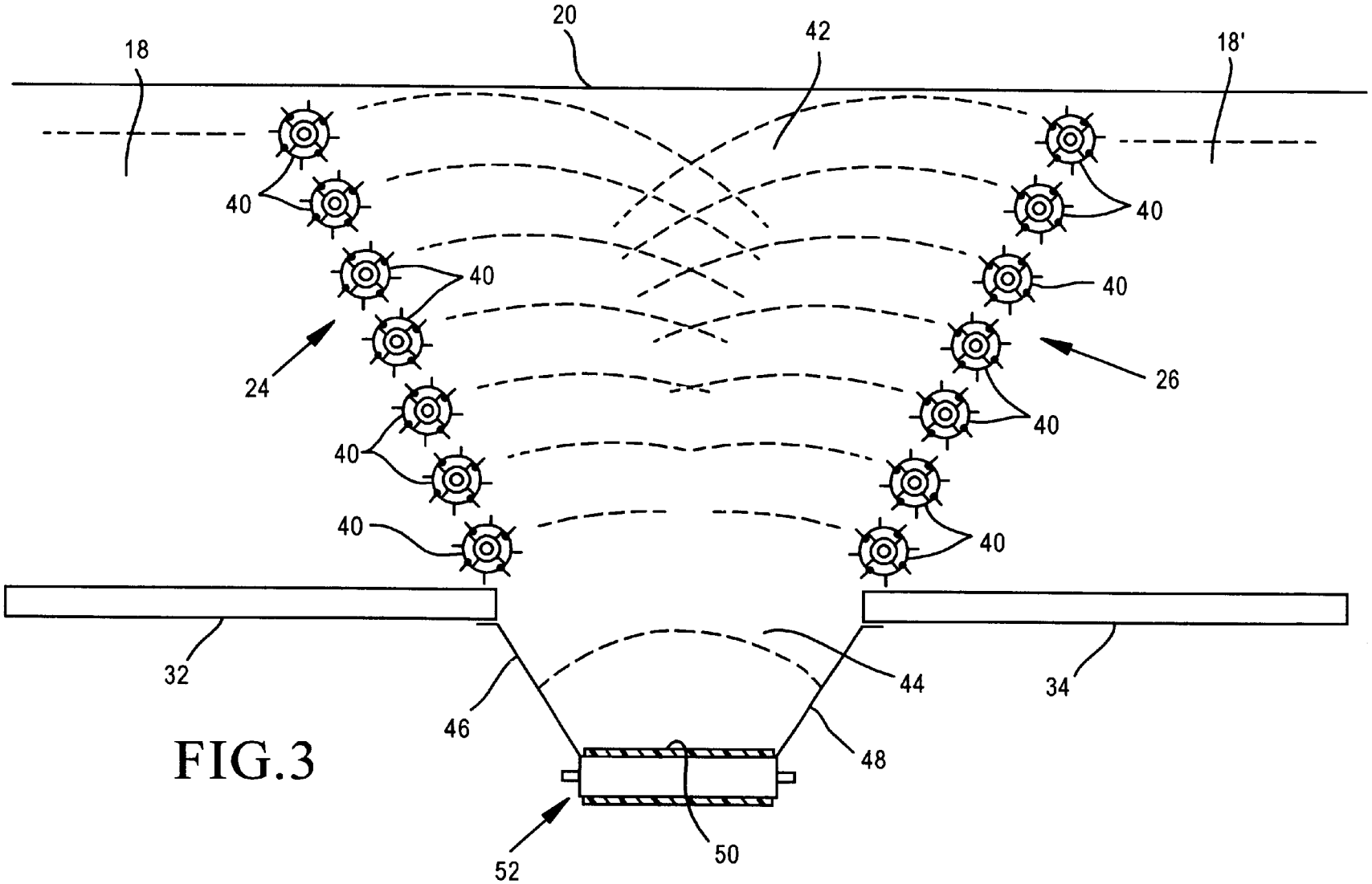
FIG. 3 is a diagrammatic sectional view through the center region of the apparatus shown by FIG. 2, showing a mixing zone formed by and between two dispersers, and an output conveyor below the mixing zone.

FIG. 3 is a longitudinal sectional view of disperser tunnel 20 and its two dispersers 24, 26. In FIG. 3, the structure is somewhat schematically shown as the constructional details of the tunnel 20 is not particularly important to the present invention. FIG. 3 shows conveyor 32 positioned and arranged to feed the modules 18, 18', 18", 18'" into the input sides of the dispersers 24, 26, respectively. In this embodiment, the dispersers 24, 26 are identical and each comprises a plurality of disperser rolls 40. In each disperser 24, 26, the bank of rolls 40 lean to the rear from vertical. A lean angle x (FIG. 9) of about thirty degrees (30°) is illustrated. A mixing zone 42 in the shape of an inverted trapezoid is defined by and between the two dispersers 24, 26 and below the top of the disperser tunnel 20. Mixing zone 42 includes a lower portion 44 situated below the conveyors 32, 34 and above the upper run 50 of an outfeed conveyor 52. Mixing zone portion 44 includes sidewalls 46, 48 that slope downwardly from the conveyors 32, 34 to the upper run 50 of the conveyor 52.

Figure 4:
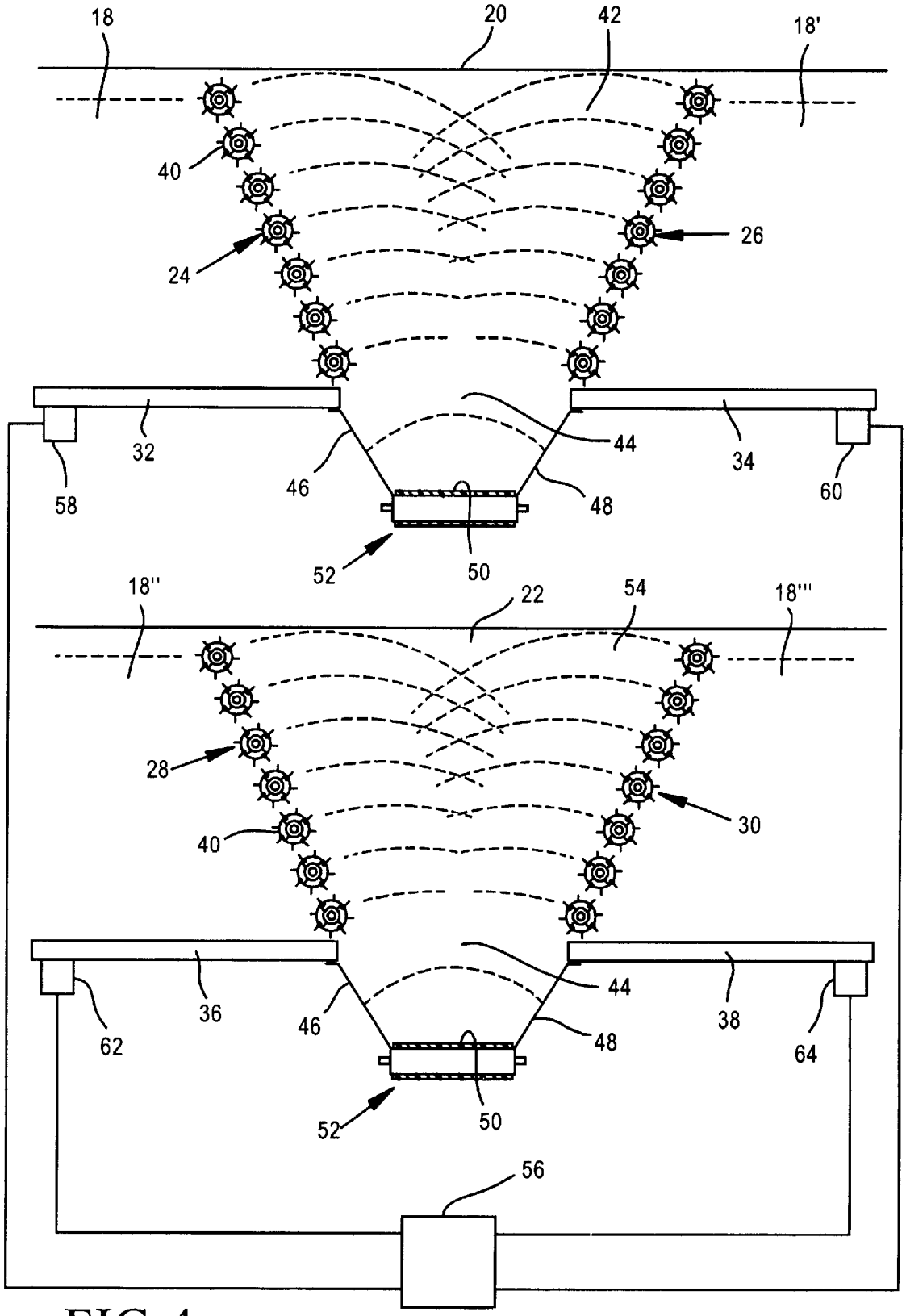
FIG. 4 is a view similar to FIG. 3, but showing two pairs of dispersers, a mixing zone between the dispersers of each pair, and including a schematic diagram of a computer controlled system for controlling the speed rate of the conveyors that deliver the cotton modules to the dispersers.
Figure 5:
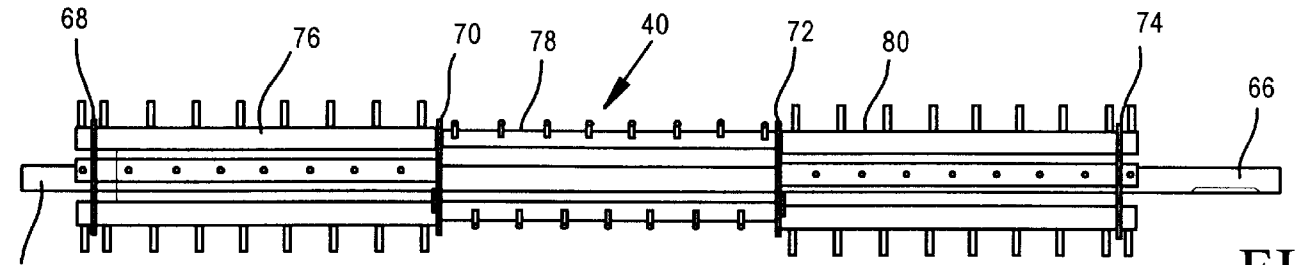
FIG. 5 is a side elevational view of one of the disperser rollers.

FIG. 4 shows a schematic of the disperser tunnel 22 below the schematic of the disperser tunnel 20. In FIG. 4, a mixing zone 54 is shown between the two dispersers 28, 30 and below the top of the mixing tunnel 22. Mixing zone 54 is in series with mixing zone 42 and it shares the same outfeed conveyor 52 and the same sidewalls 46, 48.

At times, it may be desirable to use a single disperser (e.g. disperser 24) in a single disperser tunnel (e.g. tunnel 20), in which case the associated conveyor (e.g. conveyor 32) will be operated to move modules 18 into the dispersing tunnel and against the rolls 40 of the disperser 24.

Figure 9:
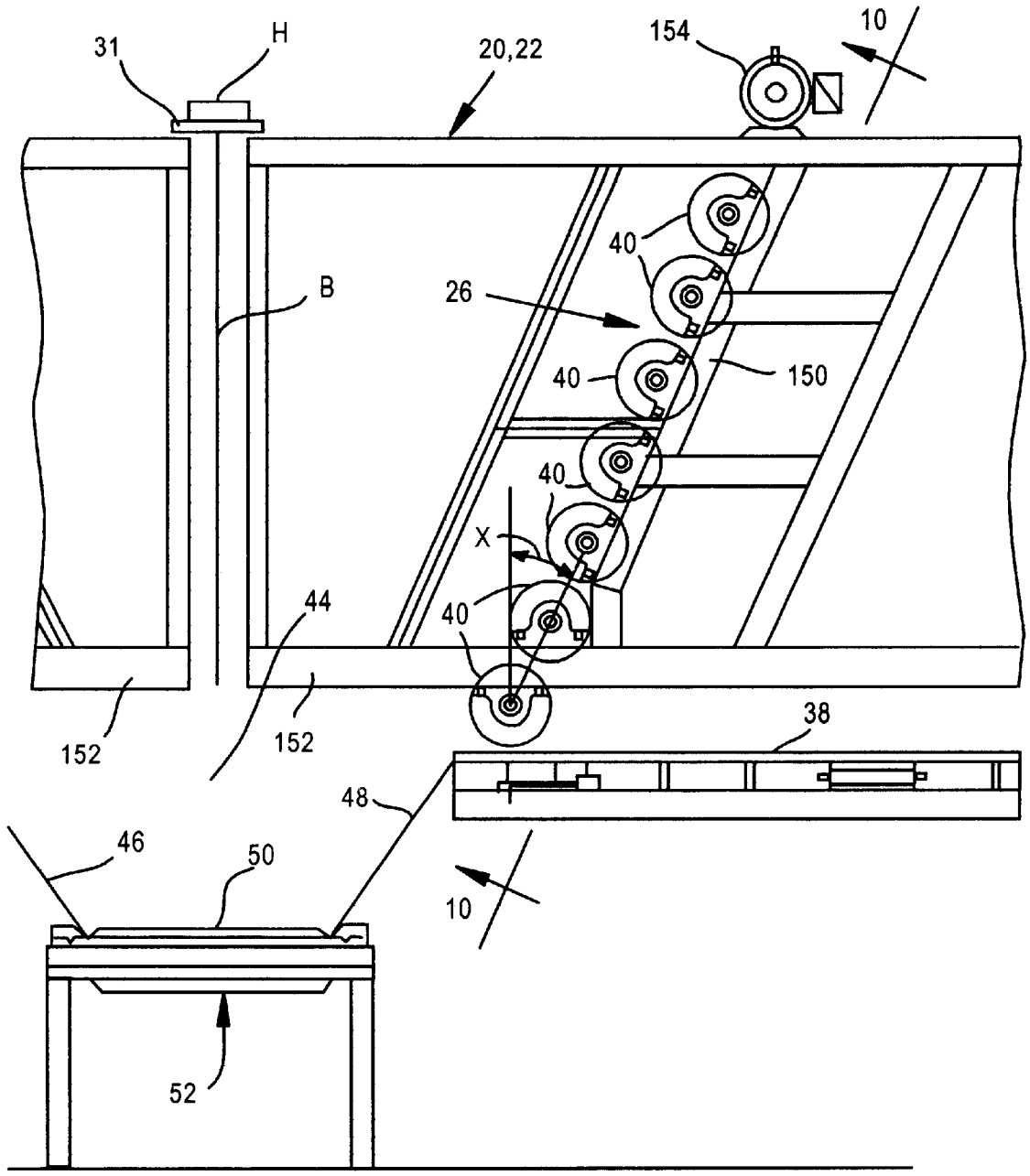
FIG. 9 is a fragmentary view looking towards one side of one of the disperser tunnels, such view showing the two end halves of the disperser tunnel moved apart and a baffle positioned in the center of the mixing zone, between the two dispersers, such view also showing how the disperser rolls and drive motor are mounted on the frame of the disperser tunnel.
Figure 11:
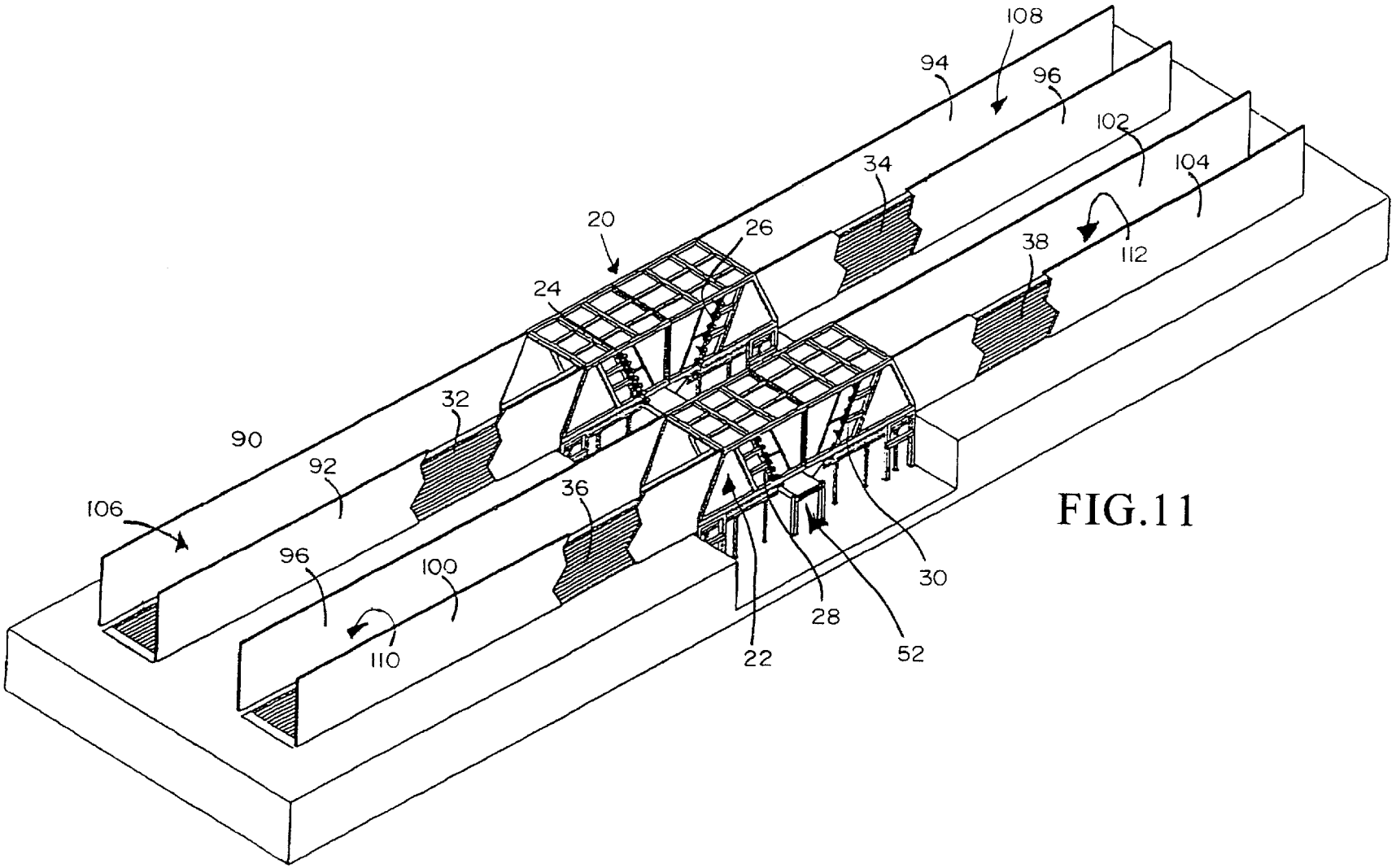
FIG. 11 is a view like FIG. 2, but showing the feed conveyors provided with sidewalls so as to define storage bins in which particulate material is stored.

Preferably, when a single disperser is used, a baffle B is positioned at the center of the disperser tunnel 20. As shown by FIGS. 2, 9 and 11, each disperser tunnel 20, 22 may be constructed in two longitudinal halves. In FIG. 9, the two halves are shown spaced apart. This is so that a baffle B can be included in the view. Preferably, the two tunnel parts are connected together and a slot is provided in the top of the assembly where the two parts meet. The slot leads into vertical slideways that are positioned to collect opposite side edge portions of the baffle B. A top plate 31 may extend along the upper edge of the baffle B. One or more handles H may be secured to the plate 31. In use, when it is desired to use only a single disperser, e.g. disperser 24, in a single disperser tunnel, e.g. tunnel 20, a workman need only pick up the baffle B by use of the handle or handles H. The lower edge of the baffle B can be dropped into the slot provided at the top of the tunnel. Then, the baffle B may be allowed to move downwardly under the influence of gravity until the top plate 31 is on top of the disperser tunnel, overlying the top and the slot and portions of the tunnel top that immediately border the slot. Whenever it is desired to use both dispersers at once, the workman need only grab the handle or handles H and pull the baffle B up out of the slideways and set it to one side of course, other ways may be used for providing a baffle B at the center of the mixing zone.

When the baffle B is in place, the fiber clumps that are being thrown into the mixing zone by the disperser that is operating will strike the baffle B and then drop downwardly onto the outfeed conveyor 52.

As will hereinafter be described in greater detail, rotation of the disperser rolls 40 will move fingers into the module 18 that will dislodge clumps of cotton bolls from the front end of the module 18. As the fingers move into, then through, and then out from the module 18, they form the clumps and then throw the clumps into the chamber 42. The clumps then fall by gravity onto the upper run 50 of the outfeed conveyor 52. The output conveyor 52 then moves the clumps on to the next station in the processing plant. Herein, the term "cotton boll clumps" includes a single cotton boll, a portion of a single cotton boll, a plurality of cotton bolls, and one or more cotton bolls stuck together by themselves or with any portion or portions of one or more additional cotton bolls. The term "textile fiber clumps" means the same thing but also includes other textile fiber materials.

Referring again to FIG. 3, at times it may be desired to remove cotton boll clumps from two modules 18, 18' at the same time, by operating both conveyors 32, 34 at the same time. Conveyor 32 is operated to move a module 18 into the input of disperser 24 while conveyor 34 is operated to move a module 18' into the input of disperser 26. When this is done, the cotton clumps from the two modules 18, 18' are mixed together in the mixing zone 42. In FIG. 3, broken lines are used to show the travel paths of the cotton boll clumps. Mixing occurs as the cotton boll clumps are propelled (viz. moved airborne) into the mixing zone 42 so it can be said that each disperser 24, 26 removes cotton boll clumps from its module 18, 18' and discharges them into the mixing zone 42 into admixture with the cotton boll clumps from the other dispenser 24, 26. When both conveyors 32, 34 and both dispersers 24, 26 are operated, a blend of cotton boll clumps is formed in the mixing zone 42. This blend drops onto the upper run 50 of the outfeed conveyor 52.

As will be appreciated, the two conveyors 32, 34 can be operated at either substantially the same feed rate or at different feed rates. When operating them at substantially the same feed rate, the blend will comprise approximately 50% cotton boll clumps from module 18 and 50% cotton boll clumps from module 18'. Or, the feed rate of the conveyors 32, 34 may be different. For example, conveyor 32 may be operated to cause travel twice as fast as conveyor 34. In this event, the blend or mixture will comprise two parts cotton boll clumps from module 18 and one part cotton boll clumps from module 18'.

Referring again to FIG. 4, it may be desirable to mix together cotton boll clumps from three grades or types of module. For example, conveyors 32, 34 and 36 may be operated at the same time, each at substantially the same feed rate or at different feed rates. In this mode of operation, a baffle B will be inserted between disperser 28, 30. The cotton boll clumps that are dispersed from disperser 28 strike the baffle B and then fall down and are deposited onto the blend of cotton boll clumps from dispersers 24, 26 that is on the upper run 50 of the conveyor 52.

The system also permits the mixing together of cotton boll clumps from four distinct modules. This is done by utilizing all four conveyors 32, 34, 36, 38 for simultaneously feeding four modules 18, 18', 18", 18'", each with a different quality content. Operation of conveyers 32, 34 and dispersers 24, 26 will admix cotton boll clumps from modules 18, 18'. They will drop down onto the upper run 50 of the conveyor 52. Operation of conveyors 36, 38 and dispersers 28, 30 together will admix cotton boll clumps from modules 18", 18'". This mixture will drop on the mixture of cotton boll clumps from modules 18, 18' which is already on the upper run 50 of the conveyor 52.

FIG. 4 shows a schematic diagram of a control system that includes a programmed computer 56 that is adapted to send control signals to feed control devices 58, 60, 62, 64 associated with the conveyors 32, 34, 36, 38. The control system disclosed in the aforementioned U.S. Pat. No. 5,934, 445 includes a programmable processor or computer and circuit components for varying the feed rate of the conveyor. It is within the skill of the art for a programmer to adapt the processor 56 so that it can be used for controlling the feed rates of the four conveyors 32, 34, 36, 38. The processor 56 can be programmed to select how many of the conveyors 32, 34, 36, 38 will be used at a given time, and the feed rate of each conveyor. It can also be programmed to turn the dispersers 24, 26, 28, 30 on and off, and also control the speed rate of the rollers 40.

Keith Manufacturing Company of 401 N.W. Adler, Madras, Oreg. 97741, makes a conveyor known as the "Running Floor II®" unloading system or unloader. This system controls the feed rate of the conveyor by controlling the output of the pump that delivers hydraulic fluid to the hydraulic cylinders that move the conveyor slats. The pump output is controlled by controlling revolutions per minute of the tractor motor that drives the pump. In the system of FIG. 4, the conveyors 32, 34, 36, 38 can be Running Floor II® conveyors. The processor 56 can be programmed to vary the drive input to the pump or in another suitable way, vary the flow rate of hydraulic fluid to the hydraulic cylinders that move the conveyor slats.

Various ways may be used to determine the feed rate of fiber. clumps into the mixing zones. For example, it can be calculated from knowing the cross sectional dimensions of the module and the conveyor speed: Also, sensors may be provided along the path of travel of each module and used to determine movement of a particular part of the module over a particular amount of time. Each module may be provided with a mark on its side or top and the sensors may be positioned to monitor the position of this mark. The information received from the sensors can then be fed to the control system, as a feedback system, and used for changing the speed rate of the conveyor.

FIGS. 5–8 show a preferred construction of the disperser roll 40, also termed the "spike roll". This construction is quite simple but yet provides a very sturdy, durable roller. In preferred form, roller 40 includes an elongated tubular core 60 that extends substantially the full length of the main body of the roll. Core 60 is mounted for rotation by a live shaft 62 having end portions 64, 66 that extend axially outwardly of the opposite ends of the core 60. The core tube 60 may be supported on the member or members that provide the live shafts 64, 66 in any suitable manner, such as by use of disks or spiders that project radially outwardly from the members 64, 66 to the core tube 60. Members 64, 66 may be opposite end portions of a continuous member that extends all the way through the core tube 60. Or, they may be shorter members that are connected to the opposite end portions of the tubular core member 60.

According to the present invention, the roll is divided into a plurality of sections by radial disks. In the illustrated embodiment, four disks 68, 70, 72, 74 are used. They divide the roll 40 into three sections that may be of substantially the same length or their lengths may vary to some extent. The disks 68, 70, 72, 74 may have a circular outline and may include a circular center opening through which the core tube 60 extends. The disks 68, 70, 72, 74 may be welded to the core tube 60.

The live shaft end portions 64, 66 are mounted for rotation in bearings. Shaft end portion 66 is connected to a suitable drive device for rotating the shaft portion 66, and hence, the roll 40. Bearing support systems and drive systems for disperser rolls are known in the prior art and do not per se form a part of the present invention.

Figure 6:
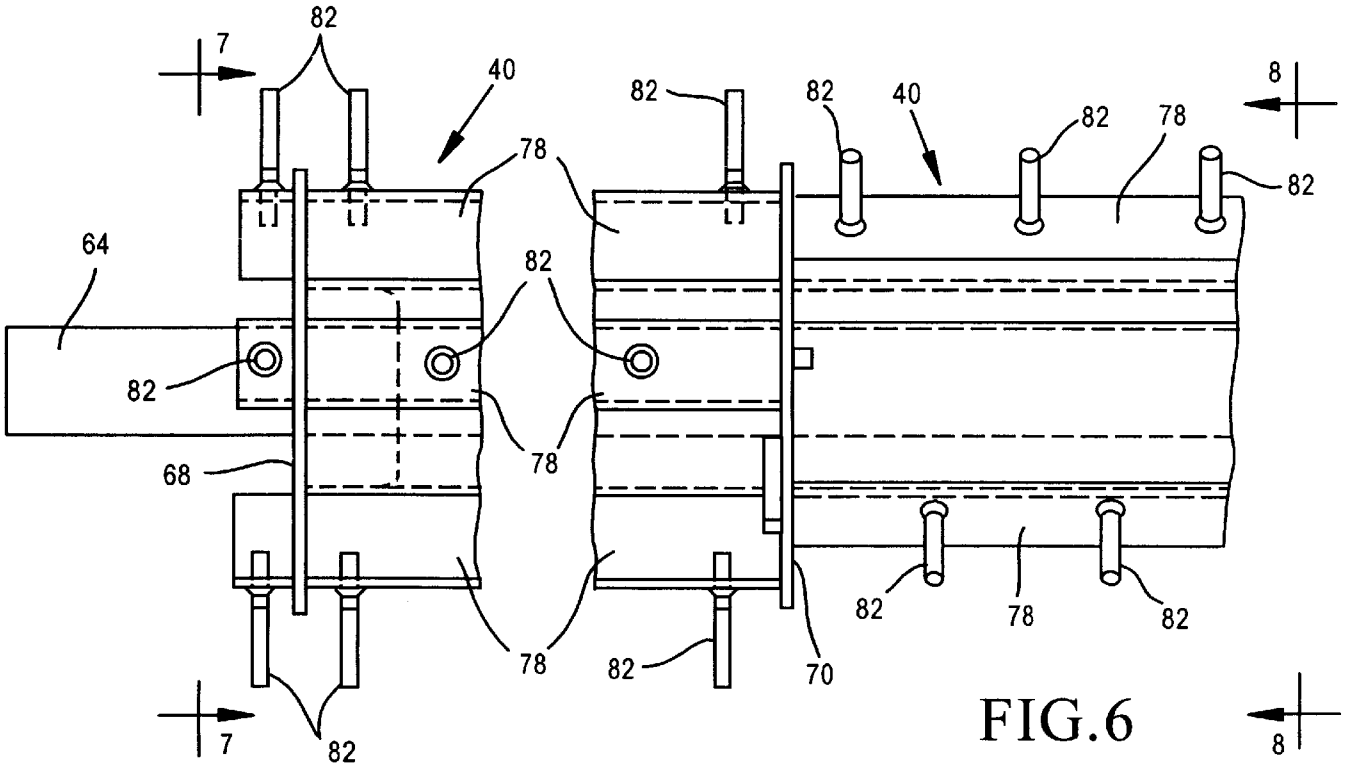
FIG. 6 is an enlarged scale fragmentary view of the roller shown by FIG. 5.
Figure 8:
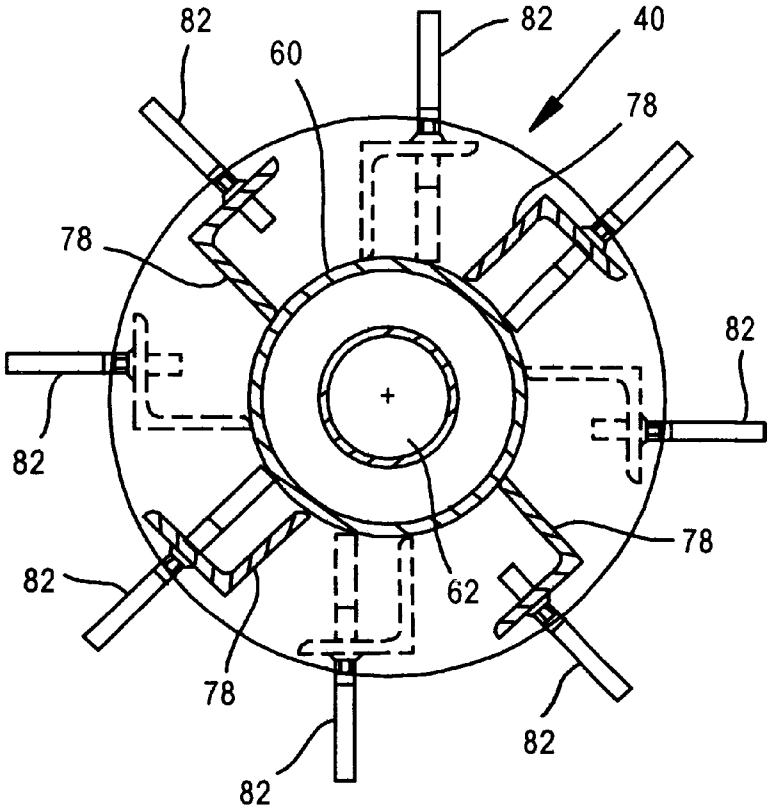
FIG. 8 is a sectional view taken substantially along line 8—8 of FIG. 6.
Figure 7:
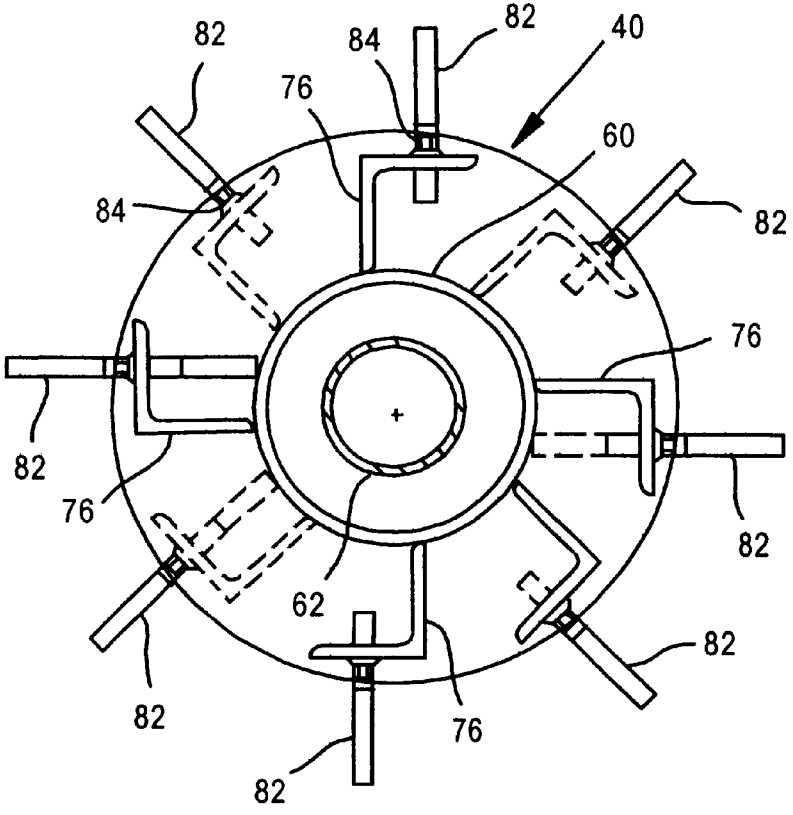
FIG. 7 is a sectional view taken substantially along line 7—7 of FIG. 6.

According to the present invention, a plurality of elongated tooth support members 76, 78, 80 are spaced around the tubular core, as shown by FIGS. 6 and 7. By way of typical and therefore non-limitive example, there are four members 76, four members 78, and four members 80. As shown by FIGS. 7 and 8, the two support members for each section are angularly spaced in position from the two support members of the adjacent section. In FIG. 7, the two support members 76 are shown at north, east, south and west positions. In FIG. 8, the two support members are shown in northeast, southeast, southwest and northwest positions. The two support members 80 are in axial alignment with the two support members 76. In other words, they are also in north, east, south and west positions and the 76, 78 are in the positions shown by FIGS. 7 and 8.

In preferred form, each tooth support member 76, 78, 80 is a length of angle iron. The angle iron members 76, 78, 80 are positioned such that they present an inner leg that preferably contacts the core tube 60 and an outer leg. The outer leg is substantially perpendicular to the inner leg and extends chordwise of the disks 68, 70, 72, 74. The inner leg is perpendicular to the outer leg but does not extend radially. The opposite ends of the two support members 76, 78, 80 are welded or otherwise firmly connected to the disks 68, 70, 72, 74.

Each tooth support member 76, 78, 80 supports a plurality of teeth or "spikes" 82 that are detachably connected to the outer leg of the tooth support member 76, 78, 80. The teeth or spikes 82 may be in the form of rods provided with a threaded connection 84 where they are connected to the tooth support members 76, 78, 80. As will be apparent, the angular staggering of the tooth support members 76, 78, 80 results in an angular staggering of the teeth 82 in the center section relative to the teeth 82 in the two end sections.

Figure 10:
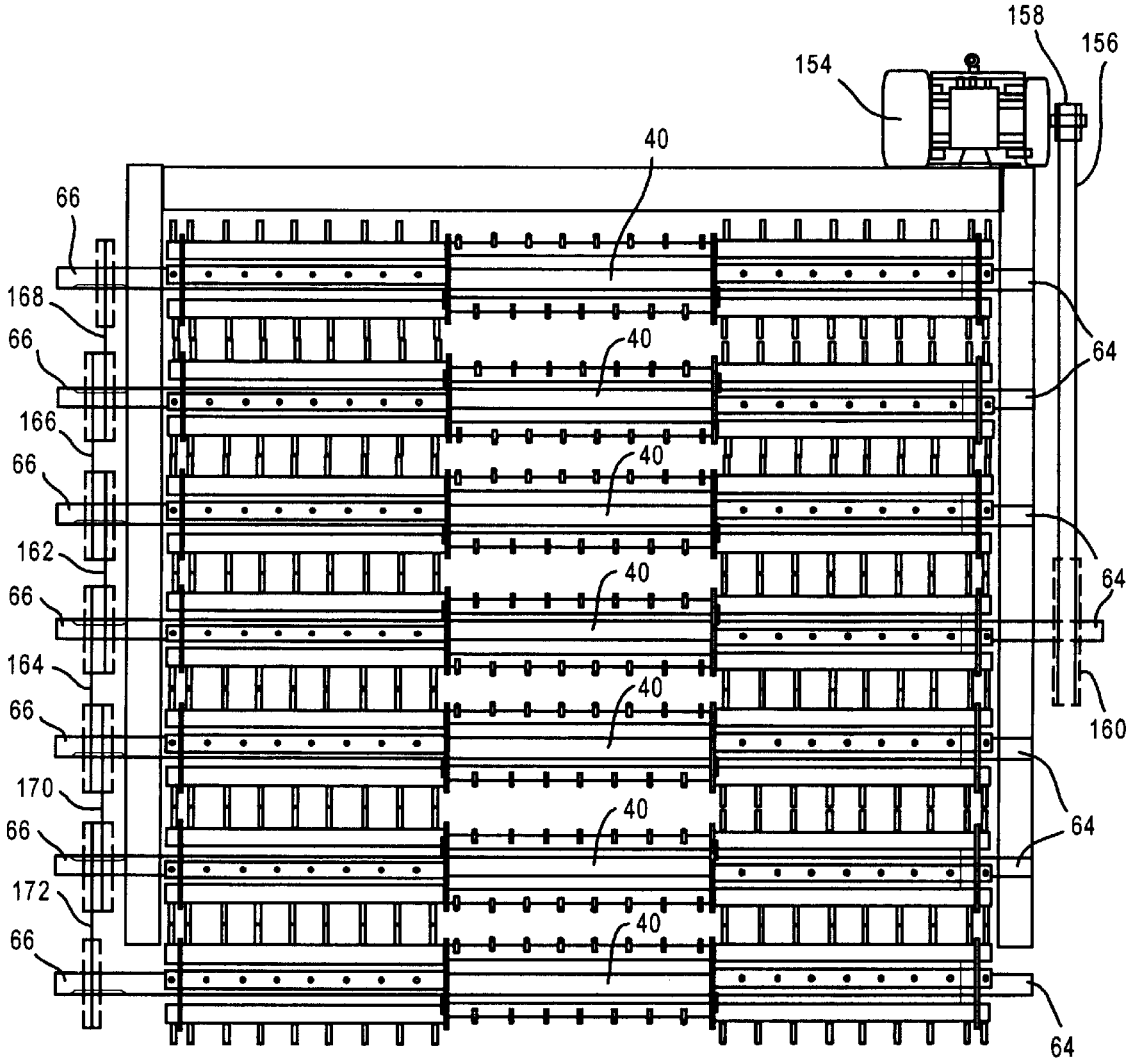
FIG. 10 is a sectional view taken substantially along line 10—10 of FIG. 9, such view including a drive train diagram showing how the disperser rolls are connected to the drive motor.

Referring to FIGS. 9 and 10, the disperser roll shafts 64, 66 are mounted onto frame portions of the tunnel structure 20, 22 by bearing assemblies that are shown in FIG. 9. Preferably, the tunnel structure includes diagonal frame members, one of which is designated 150 in FIG. 9. It also includes bottom rails, one of which is designated 152 in FIG. 9. In the illustrated embodiment, the bearing blocks for the upper five disperser rolls 40 are bolted to the frame member 150. The bearing block for the lowest disperser roll 40 is bolted to the bottom of frame member 152. The bearing block for the disperser roll 40 that is second from the bottom is bolted to the top of frame member 152. For each disperser 24, 26, 28, 30 a drive motor 154 is mounted on top of the disperser tunnel. As shown in FIG. 10, a drive belt assembly 156 may connect an output pulley 158 on motor 154 to a pulley 160 that is connected to end shaft 64 of the center disperser roll 40. In the illustrated embodiment, there are seven disperser rolls 40. Thus, there are three disperser rolls 40 above and three disperser rolls 40 below the center disperser roll 40. By way of typical and therefore non-limitive example, the drive belt assembly may comprise five vee belts. As also shown by FIG. 10, at the opposite ends of the disperser rolls 40, pulleys are connected to the end shaft 66 of the disperser rolls 40. Drive belts 162, 164, 166, 168, 170, 172 interconnect adjacent pulleys. The pulley on end shaft 66 for the center disperser is connected to both the pulley on the end shaft 66 above it and the pulley on the end shaft 66 below it. The connection pattern of the pulleys 162, 164, 166, 168, 170, 172 is shown in FIG. 10. Preferably, the belts are cogged belts or are timing belts. The belt and pulley drive system that is illustrated operates to rotate the disperser rolls 40 in the same direction and at substantially the same speed. The direction may be either clockwise or counterclockwise. The speed may be a variable speed that is determined by the output of motor 154. That is, a variable speed motor 154 may be used. Or, the motor may include a variable speed output transmission.

FIG. 11 shows a modified system of the present invention. In this system, the disperser tunnels 20, 22, the dispersers 24, 26, 28, 30, the feed conveyors 32, 34, 36, 38 may all be the same as their counterparts in FIGS. 2–10. The only difference is that the conveyors 32, 34, 36, 38 have been provided with sidewalls for the purpose of defining storage bins above each feed conveyor. Feed conveyor 32 is provided with sidewalls 90, 92 that along with the conveyor 32 form a storage bin 106. Conveyor 34 and sidewalls 94, 96 form a storage bin 108. Conveyor 36 and sidewalls 98, 100 form storage bin 110. Conveyor 38 and sidewalls 102, 104 together form a storage bin 112. In this embodiment, particulate material is placed in the storage bins 106, 108, 110, 112. The particulate material may extend partway up or all the way up to the tops of the dispersers 24, 26, 28, 30. Broken lines are shown in FIGS. 3 and 4 at about the level of the uppermost disperser roll 40 in the dispersers 24, 26, 28, 30. The particulate material may extend up to this broken line. Or, the height of particulate material in the storage bins 106, 108, 110, 112 may be at some level below the broken lines.

As in the case of the textile fibers, two, three or all four of the disperser units may be used together for the purpose of mixing or blending different kinds or grades of particulate material in the several storage bins 106, 108, 110, 112. For example, conveyors 32, 34 may be operated for delivering particulate material to the input sides of the dispersers 24, 26. As shown in FIGS. 3 and 4, the dispersers may function to dislodge particles from the bodies of particles in the storage bins 106, 108 and propel them into the mixing zone 44, so as to form a blend or mixture that then gravitates onto the upper run 50 of the outfeed conveyor 52. A third conveyor, e.g. conveyor 36, may be operated to deliver additional particulate material to disperser 28 and disperser 28 may be used for feeding particles of such particulate material into the mixing zone 54, preferably against the baffle B. These particles will then fall down onto the blend of particles that is on the upper run 50 of the conveyor 52. When all four units are used, the particle material delivered by conveyors 36, 38 from storage bins 110, 112 are fed into the dispersers 28, 30. The disperser rolls 40 remove particles from the bodies of particulate material that are being fed to the dispersers 28, 30 and propel such particles into the mixing zone 42. The mixture or blend then falls down onto the mixture or blend of particles from dispersers 24, 26 that are already on the upper run 50 of the conveyor 52.

The system is usable for measuring and mixing any types of particles that one may want to mix. Different sizes or kinds of wood chips may be mixed. Wood chips may be mixed with coal is particles, and then the mixture compressed into logs to be used as fuel. Or, wood chips can be mixed with plastic chips. Or different sizes and kinds of plastic chips can be mixed together.

The illustrated embodiments are only examples of the present invention and, therefore, are non-limitive. It is to be understood that many changes in the particular structure, materials and features of the invention may be made without departing from the spirit and scope of the invention. Therefore, it is my intention that my patent rights not be limited by the particular embodiments illustrated and described herein, but rather determined by the following claims, interpreted according to accepted doctrines of claim interpretation, including use of the doctrine of equivalents and reversal of parts.

What is claimed is:

1. Apparatus for dispersing textile fiber clumps from a plurality of textile fiber modules and then mixing the clumps to form a blend, comprising:

a pair of confronting dispersers, each having an input side and an output side, said output sides facing each other on opposite sides of a mixing zone;

a feed conveyor for each disperser, each positioned to feed cotton modules into the input side of its disperser; and an outfeed conveyor between the two dispersers, at the bottom of the mixing zone, wherein the feed conveyors are positioned to move textile fiber modules to the dispersers, each disperser removes fiber clumps from its module and discharges them into the mixing zone into admixture with fiber clumps entering the mixing zone airborne from the other disperser, and the mixed blend of fiber clumps falls on the outfeed conveyor and the outfeed conveyor carries the blend of fiber clumps away from the mixing zone.

2. The apparatus of claim 1, wherein the outfeed conveyor extends generally perpendicular to the two feed conveyors.

3. The apparatus of claim 1, wherein the feed conveyors are reciprocating slat conveyor.

4. The apparatus of claim 1, wherein the feed conveyors are reciprocating slat conveyors and the outfeed conveyor is an endless belt conveyor.

5. The apparatus of claim 1, wherein each disperser comprises a plurality of power driven rollers, each of which is supported for rotation about a horizontal axis and includes a plurality of fingers that move into and then out from the module as the rollers rotate, said fingers being adapted to remove textile fiber clumps from the module and project them into the mixing zone.

6. The apparatus of claim 5, wherein the outfeed conveyor extends generally perpendicular to the two feed conveyors.

7. The apparatus of claim 5, wherein the feed conveyors are reciprocating slat conveyors.

8. The apparatus of claim 5, wherein the feed conveyors are reciprocating slat conveyors and the outfeed conveyor is an endless belt conveyor.

9. Apparatus for dispensing cotton boll clumps from a plurality of textile fiber modules and then mixing the clumps to form a blend, comprising:

a first pair of confronting dispersers, each having an input side and an output side, said output sides facing each other on opposite sides of a first mixing zone;

a second pair of confronting dispersers, each having an input side and an output side, said output sides facing each other on opposite sides of a second mixing zone;

a feed conveyor for each disperser, each positioned to feed cotton modules into the input side of its disperser; and an outfeed conveyor at the bottom of the mixing zone, wherein the feed conveyors are positioned to move textile fiber modules to the dispersers, each disperser removes textile fiber clumps from its module and discharges them airborne into a mixing zone into admixture with textile fiber clumps delivered airborne into the mixing zone from the disperser on the other side of the mixing zone, and the mixed blend of cotton boll clumps falls onto the outfeed conveyor and the outfeed conveyor carries the blend of textile fiber clumps away from the dispersers.

10. The apparatus of claim 9, wherein the outfeed conveyor extends generally perpendicular to all of the feed conveyors.

11. The apparatus of claim 9, wherein the feed conveyors are reciprocating slat conveyors.

12. The apparatus of claim 9, wherein the feed conveyors are reciprocating slat conveyors and the outfeed conveyor is an endless belt conveyor.

13. The apparatus of claim 9, wherein each disperser comprises a plurality of power driven rollers, each of which is supported for rotation about a horizontal axis and includes a plurality of fingers that move into and then out from the module as the rollers rotate, said fingers being adapted to remove textile fiber clumps from the module and projecting them into the mixing zone.

14. The apparatus of claim 13, wherein the outfeed conveyor extends generally perpendicular to the two feed conveyors.

15. The apparatus of claim 13, wherein the feed conveyors are reciprocating slat conveyors.

16. The apparatus of claim 13, wherein the feed conveyors are reciprocating slat conveyors and the outfeed conveyor is an endless belt conveyor.

17. A method of dispersing and blending textile fiber clumps from a plurality of textile fiber modules, comprising:

positioning first and second dispersers at a disperser station, in a spaced apart confronting relationship, so as to define a mixing zone between them;

operating the first and second dispersers together while feeding a first textile fiber module against the first disperser and feeding a second textile fiber module against the second disperser;

operating said first and second dispersers together so that each will disperse fiber clumps from its module and deliver them airborne into the mixing zone in admixture with the fiber clumps entering the mixing zone airborne from the other disperser; and collecting the mixture of fiber clumps at the bottom of the mixing zone and carrying the mixture away from the disperser station.

18. The method of claim 17, comprising feeding the modules against the dispersers by use of conveyors, and controlling the feed rate by controlling conveyor speed.

19. The method of claim 17, comprising positioning third and fourth dispersers at the disperser station in a spaced apart confronting relationship, so as to define a second mixing zone between them;

operating the third and fourth dispersers together while feeding a third textile fiber module against the third disperser and feeding a fourth textile fiber module against the fourth disperser;

operating said third and fourth dispersers so that each will disperse fiber clumps from its module and deliver them airborne into the second mixing zone in admixture with the airborne fiber clumps from the other disperser of the pair; and collecting the mixture of cotton boll clumps at the bottom of the second mixing zone, on top of the mixture of fiber clumps from the first mixing zone, and carrying the total mixture away from the disperser stations.

20. The method of claim 19, comprising using a conveyor for collecting the mixtures from the bottoms of the mixing zones and carrying the combined mixture away from the disperser station.

21. The method of claim 19, further comprising using conveyors for feeding the textile fiber modules against the dispersers, and controlling the feed rate by controlling conveyor speed.

22. The method of claim 21, comprising using reciprocating slat conveyors for feeding the textile fiber modules to the dispersers.

23. The method of claim 21, comprising operating the conveyors for feeding each module to its disperser at a different rate from the speed of the other modules to its disperser.

24. The method of claim 21, comprising operating the conveyors for feeding each module to its disperser at a different rate from the speed of the other modules to its disperser.

25. Apparatus for dispersing particles of particulate material from a plurality of bins in which the particulate material is held and then mixing the particles to form a blend, comprising:

a pair of confronting dispersers, each having an input side and an output side, said output sides facing each other on opposite sides of a mixing zone;

a storage bin for particulate material associated with each disperser, each storage bin having an outlet end confronting the input side of its disperser;

a feed conveyor in each storage bin positioned to convey particulate material from the bin to the disperser; and an outfeed conveyor between the two dispersers, at the bottom of the mixing zone, whereby the feed conveyors are positioned to move particulate material from the two storage bins to the two dispersers, each disperser removes particles from its storage bin and discharges them airborne into the mixing zone into admixture with particles introduced airborne into the mixing zone from the other disperser, and the mixed blend of particles falls on the outfeed conveyor and the outfeed conveyor carries the blend of particles away from the mixing zone.

26. The apparatus of claim 25, wherein the outfeed conveyor extends generally perpendicular to the two feed conveyors.

27. The apparatus of claim 25, wherein the feed conveyors are reciprocating slat conveyors.

28. The apparatus of claim 25, wherein the feed conveyors are reciprocating slat conveyors and the outfeed conveyors is an endless belt conveyor.

29. The apparatus of claim 25, wherein each disperser comprises a plurality of power driven rollers, each of which is supported for rotation about a horizontal axis and includes a plurality of projections that move into and then out from the particulate material as the rollers rotate, staid projections being adapted to remove particles from the particulate material in the storage bins and project them into the mixing zone.

30. The apparatus of claim 29, wherein the outfeed conveyor extends perpendicular to the two feed conveyors.

31. The apparatus of claim 29, wherein the feed conveyors are reciprocating slat conveyors.

32. The apparatus of claim 29, wherein the feed conveyors are reciprocating slat conveyors and the outfeed conveyor is an endless belt conveyors.

33. The apparatus of claim 25, comprising a second pair of confronting dispersers, each having an input side and an output side, said output sides facing each other on opposite sides of a second mixing zone;

a second pair of particulate material storage bins associated with the second pair of confronting dispersers, each said storage bin having an output end confronting the input side of its disperser, and further having a feed conveyor at its bottom, positioned to feed particulate material that is stored in the storage bin to the input side of its disperser; and an outfeed conveyor at the bottom of the mixing zone, wherein each of the four feed conveyors is positioned to be selected to move particulate material from its particulate material storage bin to its disperser, and each disperser that receives such material is adapted to remove particles from the material and discharge them airborne into a mixing zone into admixture with particles entering airborne from the disperser on the other side of the mixing zone, and the mixed blend of particles falls onto an outfeed conveyor and the outfeed conveyor carries the particle blend away from the dispersers.

34. The apparatus of claim 33, wherein the same outfeed conveyor travels through both mixing zones and receives particles from each mixing zone.

35. A method of dispersing and blending particles from a plurality of storage bins in which particulate material is stored, comprising:

positioning first and second dispersers at a disperser station, in a spaced apart confronting relationship, so as to define a mixing zone between them;

operating the first and second dispersers while feeding a first body of particulate material against the first disperser and feeding a second body of particulate material against the second disperser;

operating said first and second dispersers so that they each will disperse particles from its body of particulate material and deliver them airborne into the mixing zone in admixture with the airborne particles from the other disperser; and collecting the mixture of particles at the bottom of the mixing zone and carrying the mixture away from the disperser station.

36. The method of claim 35, comprising positioning third and fourth dispersers in a spaced apart confronting relationship, so as to define a second mixing zone between them;

operating the third and fourth dispersers while feeding a third body of particulate material against a third disperser and feeding a fourth lot of particulate material against the fourth disperser;

operating said third and fourth dispersers so that they each will disperse particles from its body of particulate material and deliver them airborne into the second mixing zone in admixture with the airborne particles from the other disperser of the pair; and collecting the mixture of particles at the bottom of the second mixing zone, on top of the mixture of particles from the first mixing zone, and carrying the total mixture away from the disperser stations.

37. The method of claim 36, comprising feeding the bodies of particulate material against the dispersers by use of conveyors, and controlling the feed rate by controlling the conveyor speed.

38. The method of claim 36, comprising feeding the bodies of particulate material against the dispersers by use of conveyors, and controlling the feed rate by controlling the conveyor speed.

* * * * *